US008402913B2

(12) United States Patent
Smythe

(10) Patent No.: US 8,402,913 B2
(45) **Date of Patent: *Mar. 26, 2013**

(54) DRYWALL MUD HOPPER FOR INSIDE AND OUTSIDE CORNERS

(76) Inventor: Timothy D. Smythe, Bend, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/159,240

(22) Filed: Jun. 13, 2011

(65) Prior Publication Data

US 2011/0297078 A1 Dec. 8, 2011

Related U.S. Application Data

(60) Continuation of application No. 12/316,666, filed on Dec. 15, 2008, now Pat. No. 7,959,978, which is a division of application No. 11/804,707, filed on May 18, 2007, now abandoned, which is a continuation-in-part of application No. 10/745,958, filed on Dec. 27, 2003, now Pat. No. 7,220,317.

(60) Provisional application No. 60/436,998, filed on Dec. 28, 2002.

(51) Int. Cl.
*B05C 3/02* (2006.01)

(52) U.S. Cl. ..... 118/404; 118/405; 118/413; 427/356; 425/87

(58) Field of Classification Search ..... 427/356; 15/235.7, 235.6, 235.4; 141/67; 425/87; D8/45; 401/5, 9, 11; D15/13; 118/405, 118/404

See application file for complete search history.

(56) References Cited

U.S. PATENT DOCUMENTS

| | | | | |
|---|---|---|---|---|
| 2,178,899 | A * | 11/1939 | Shaffer | 15/235.7 |
| 3,087,654 | A | 4/1963 | Moore | 401/9 |
| 3,209,389 | A | 10/1965 | Stahl | 425/87 |
| 4,230,441 | A | 10/1980 | Heronema | 425/87 |
| 4,516,868 | A | 5/1985 | Molnar | 401/5 |
| 4,734,022 | A | 3/1988 | Shimabukuro | 425/62 |
| 4,915,610 | A | 4/1990 | Curry | 425/458 |
| 5,498,287 | A | 3/1996 | Barnfield | 118/43 |
| 5,676,793 | A | 10/1997 | Martin et al. | 156/578 |
| 5,695,788 | A | 12/1997 | Woods | 425/87 |
| 6,907,908 | B1 * | 6/2005 | Weldy | 141/67 |
| 7,220,317 | B2 * | 5/2007 | Smythe | 118/404 |

OTHER PUBLICATIONS

Placor website, Convertible hopper, Oct. 20, 2001, p. 1-3.*
Pla-Cor Convertible Hopper Dec. 30, 2003.

* cited by examiner

*Primary Examiner* — Michael Cleveland
*Assistant Examiner* — Tabatha Penny
(74) *Attorney, Agent, or Firm* — Clifford Kraft

(57) ABSTRACT

A drywall hopper assembly that contains a double blade that can apply drywall mud to both interior and exterior drywall corners with no blade change. A zigzag blade can contain two grooves, one for interior corners and one for exterior corners. With this blade arrangement, an operator can quickly move from one type of corner to another without using multiple tools, multiple blades or hand application methods to apply mud. The present invention can contain a pliable release port to present mud equally to an interior or an exterior corner. There can be such a port on both the top and bottom of the blade so that mud is smoothly applied as trim moves through the hopper or the hopper is moved along the trim.

11 Claims, 6 Drawing Sheets

DRYWALL MUD HOPPER FOR INSIDE AND OUTSIDE CORNERS

This application is a continuation of application Ser. No. 12/316,666 filed Dec. 15, 2008 to issue as U.S. Pat. No. 7,959,978 Jun. 14, 2011 which was a divisional of application Ser. No. 11/804,707 now abandoned filed May 18, 2007 which was a continuation-in-part of application Ser. No. 10/745,958 filed Dec. 27, 2003 now U.S. Pat. No. 7,220,317 issued May 22, 2007. application Ser. No. 10/745,958 was related to and claimed priority from U.S. Provisional Patent Application 60/436,998 filed Dec. 28, 2002. applications Ser. Nos. 12/316,666, 11/804,707, 10/745,958 and 60/436,998 are hereby incorporated by reference.

BACKGROUND

1. Field of the Invention

The present invention relates to the field of drywall installation and more particularly to a drywall mud hopper that allows application of mud to both interior and exterior drywall corners.

2. Description of the Prior Art

Prior art hoppers only allow finishing of exterior drywall corners. This is because prior art hoppers only contain an exterior blade. Some hoppers allow changing of the blade; however, no prior art hopper contains a double blade that will allow the operator to finish both interior and exterior corners with the convenience of not having to change blades. Applying mud to inside corners without a hopper is a slow and tedious process. What is needed is a drywall mud hopper that will allow finishing of both interior and exterior corners with no blade or tool change or setup.

SUMMARY OF THE INVENTION

The present invention relates to a drywall hopper assembly that contains a double zigzag or other blade that can apply drywall mud to both interior and exterior drywall corners with no blade change.

The zigzag blade of the present invention can contain two edge grooves, one for interior corners and one for exterior corners. With this blade arrangement, an operator can quickly move from one type of corner to another without using multiple tools, multiple blades or hand application methods to apply mud.

The present invention can contain a pliable polymer release port to present mud equally to an interior or an exterior corner. There can be such a port on both the top and bottom of the blade so that mud is smoothly applied as the operator moves the tool along the seam or as trim material is moved through the tool.

Several illustrations have been presented to better explain the present invention. The scope of the present invention is not limited to the embodiments shown in the figures.

DETAILED DESCRIPTION

Figure 1:
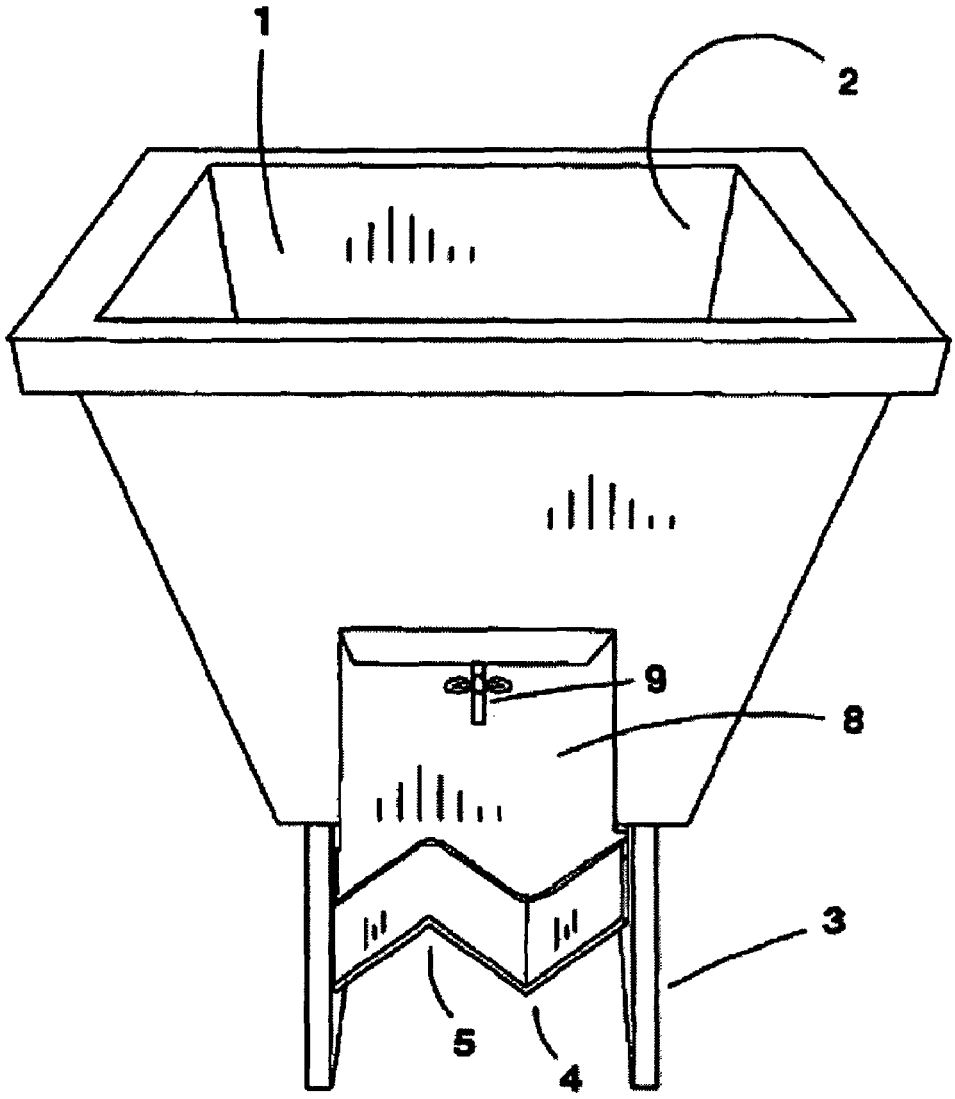
FIG. 1 shows a side perspective view of an embodiment of the present invention.
Figure 2:
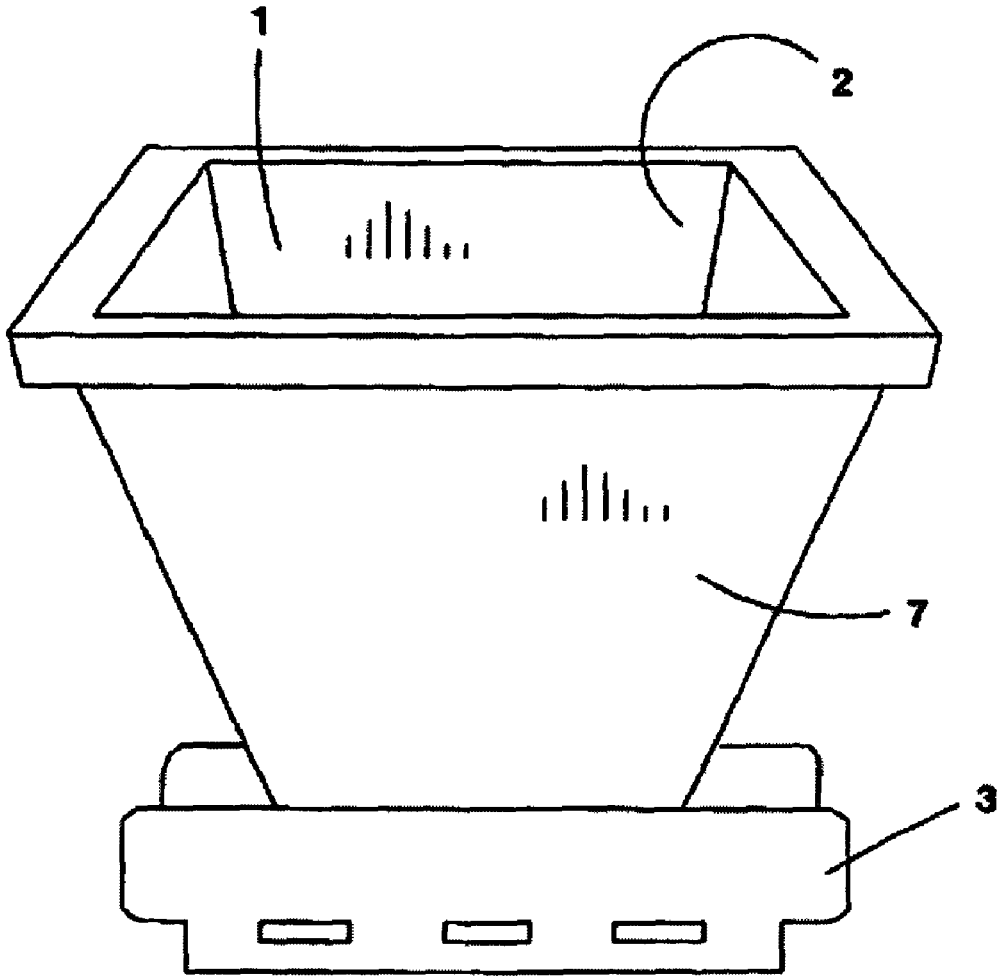
FIG. 2 shows the same view as FIG. 1 with the hopper rotated ninety degrees.

FIGS. 1-2 show general perspective views of the present invention. A hopper with slanted side walls 2 narrows into a metal blade 3 at its base. The blade 3 can contain two parallel sub-blades in the form of a zigzag, one for exterior corners 4 and one for interior corners 5. Above the blade can be a control plate 8 that can be secured to the slanting side walls 2 with a protruding screw and wingnut. The unique shape of the zigzag blade 3 and control plate 8 allows instant application of mud to both interior and exterior corners with no blade change and no manual application necessary. The hopper 1 can be made of any durable material with plastic being preferred. The blade can be any hard, very rigid material with steel or aluminum being preferred.

Figure 3:
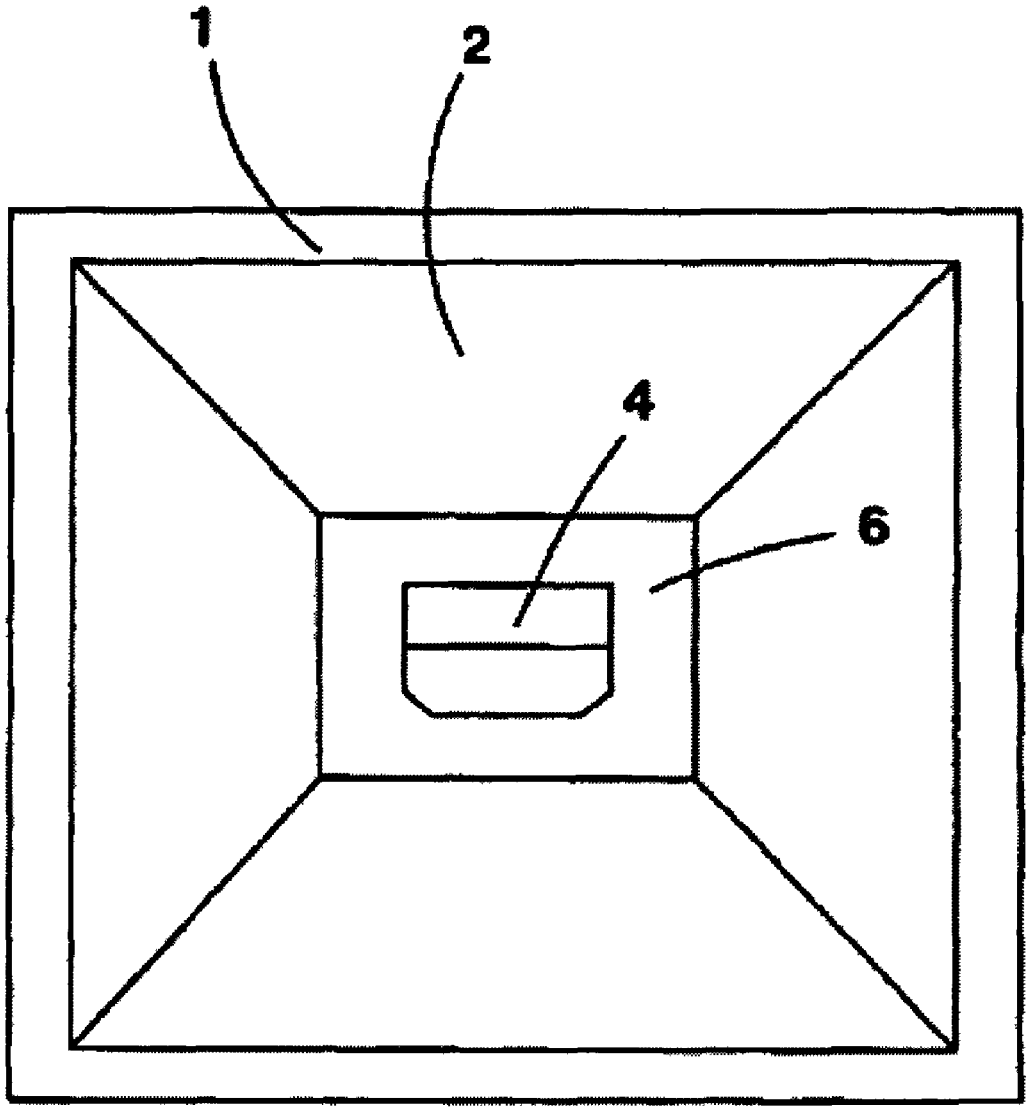
FIG. 3 shows a view looking into the top of the hopper.

FIG. 3 is a top view looking into the hopper 1. The slanted side wall 2 is visible along with a mud outlet opening 6 in the bottom of the hopper 1. The mud opening 6 dumps mud onto the blade top surface 4.

Figure 4A:
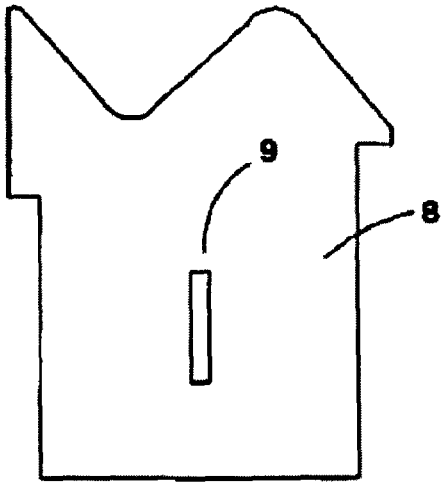
FIGS. 4A and 4B show details of an embodiment of a dispensing port with two parts.
Figure 4B:
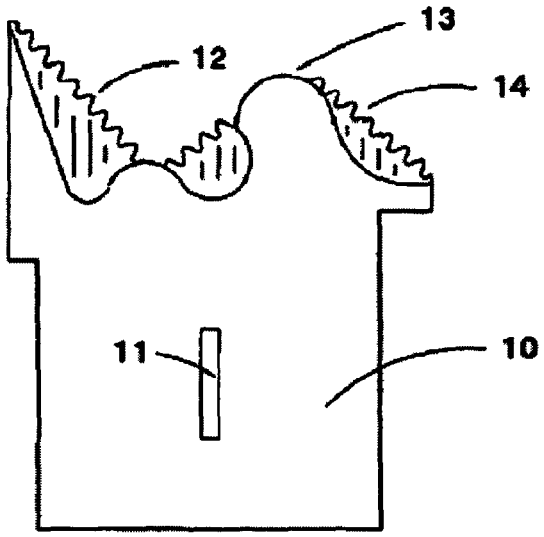

FIGS. 4A-4B show details of the control plate 8. The hopper 1 has a slanting outside surface 7 (FIG. 2) that can be secured to the blade assembly 3 so that the hopper 1 dumps drywall mud into it. The blade assembly 3 contains a double blade with a section grooved for exterior corners 5 and a section grooved for interior corners 4 if the assembly is moved against a wall, and interior corners 5 and exterior corners 4 if a piece of trim is moved through the assembly. A control plate 8 is secured onto each end of the blade with a stub screw and can be adjusted to control the release of mud. This adjustment of the end plate 8 along the stub screw determines the exact quantity of mud dispensed. FIG. 4B in particular, shows a dispensing port 10 that can be mounted behind the control plate 8 at each end of the blade 3. The dispensing port 10 is specially shaped with teeth to control the outflow of mud. It can be seen that the end port 10 has the general shape of the blade grooves 4, 5 and has teeth 12, 14 to allow and control the outflow of mud. The end port can be shaped various ways with optional protrusions 13 to reinforce the teeth.

Figure 5A:
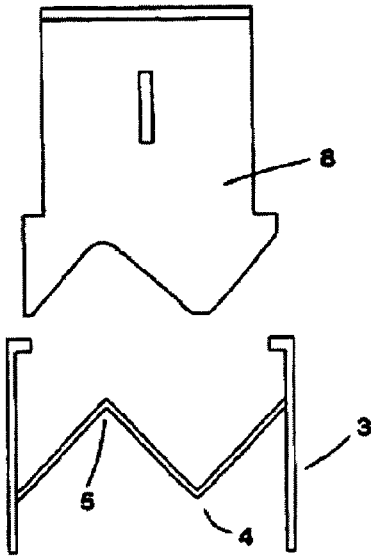
FIGS. 5A and 5B show how the dispensing port meshes with the corner matching piece.
Figure 5B:
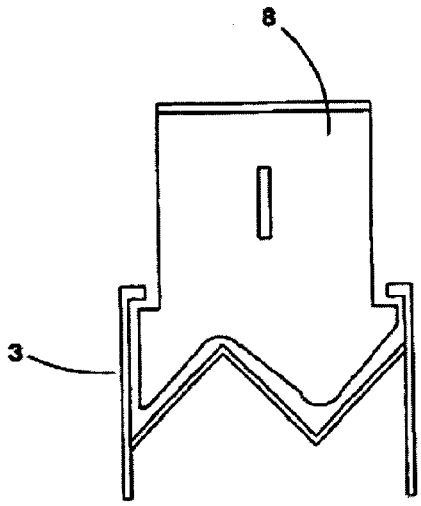

FIGS. 5A and 5B show how the control plate 8 meshes with the blade 3. Both the control plate 8 and the dispensing port 10 can contain a slot 9, 11 that follows the stub screw and allows for adjustment of the control plate 8 and dispensing port 10. The end plate can be any rigid material with steel or aluminum being preferred. The teeth 13, 15 that are attached to the dispensing port 10 can be clearly seen. These teeth allow mud to pass out as well as controlling the amount of mud. It can be seen the dispensing port 10 also follows the general shape of the blade 3 from previous figures. The dispensing port 10 is equipped with a similar slot 11 that matches the slot 9 in the control plate 8. Both the dispensing port 10 and the control plate 8 can be made of metal such as steel or aluminum or the dispensing port 10 can be made of plastic or a fibrous material, or the teeth 12, 14 can be made of a fibrous material. It should be generally noted that better performance is obtained if the dispensing port 10 is flexible. It can be made from flexible plastic, rubber or other material that bends or flexes easily. Thus the dispensing port 10 can be made out of any durable, flexible material with a polymer being preferred. Various soft plastics work well. The dispensing port 10 generally is able to bend slightly to dispense mud properly; however this bending action is optional.

Figure 6:
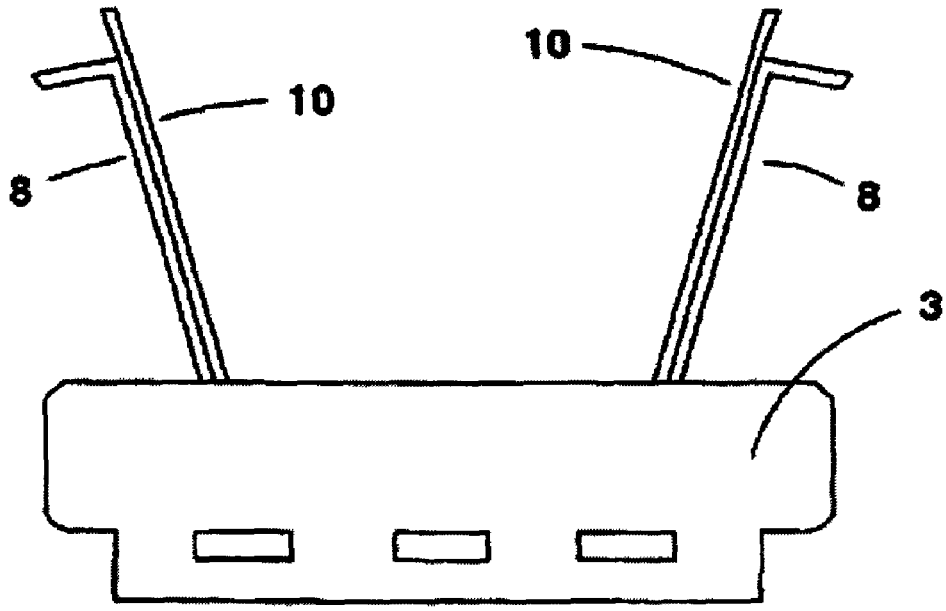
FIG. 6 shows the view of FIG. 5A turned 90 degrees.

FIG. 6 shows a side view of the blade 3, the control port 8 and the dispensing port 10 at each end of the blade. The assembly shown in FIG. 6 fits on the bottom of the hopper body 1 with the outside hopper wall 7 generally mating with the blade 3 and the dispensing port 10.

It should be noted that alternate removable blades are possible and are within the scope of the present invention. These optional removable blades could replace the blade 3 shown in the figures and be configured for different types of corners or joints.

The drywall mud hopper tool of the present invention can be used in two different manners. First, the tool can be moved along the seem to dispense mud on the sheetrock. Second a piece of trim material can be moved through the tool, or the tool can be moved along the piece of trim material to dispense mud on the trim material. In these two different applications of the tool, the role of the interior and exterior zigzag sub-blades is reversed. In the first case (tool moved), part of the double blade 5 is used for exterior corners. In the second case (trim mudded by the tool), the part of the double blade 5 is used for interior corners since it is the trim rather than the drywall that is being mudded. The same principle applies for the other part of the blade 4. For the first case this part of the blade 4 is used for interior corners, and in the second case this part of the blade 4 is used for exterior corners.

Several descriptions and illustrations have been used to explain the present invention. One of skill in the art would realize that many changes and variations are possible. These changes and variations are within the scope of the present invention.

I claim:

1. A mud dispensing hopper comprising:

a hopper body for holding a reservoir of wet mud;

a mud outlet opening in said hopper wherein wet mud can pass through said opening;

a blade attached to said hopper body in proximity to said mud outlet opening, wherein said blade contains two parts, a convex part and a concave part, and wherein one of said parts applies mud for interior corners and one of said parts applies mud for exterior corners;

a control plate in proximity to said mud outlet opening and said blade, said control plate having a first slot;

a dispensing port mounted behind said control plate at each end of said blade, the dispensing port having a second slot matching the first slot in said control plate, said control plate and dispensing port adapted to control flow of said mud.

2. The mud dispensing hopper of claim 1 wherein said dispensing port has teeth to control mud flow.

3. The mud dispensing hopper of claim 1 wherein said dispensing port is plastic.

4. The mud dispensing hopper of claim 1 wherein said dispensing port contains a plurality of teeth.

5. The mud dispensing hopper of claim 1 wherein said control plate is metal.

6. The mud dispensing hopper of claim 1 wherein said control plate is plastic.

7. The mud dispensing hopper of claim 1 wherein said blade is removable.

8. A mud hopper for use in drywall finishing work where mud is used to finish both interior and exterior drywall corners, the mud hopper being filed with wet mud from the top and dispensing the wet mud from the bottom through a mud dispensing hole, the mud hopper including a removable blade mounted in proximity to the bottom of the mud hopper so that wet mud flows out of the hopper and along the blade to and onto a drywall corner, flow of wet mud being controlled by at least one control plate mounted in proximity to the blade in a position to control rate of flow of the mud, the control plate having a first slot and being adjustable to allow different mud flow rates, the control plate being shaped to approximately match the contour of the blade; said blade containing two parts, a convex part and a concave part; wherein one of said parts applies mud for interior corners and one of said parts applies mud for exterior corners; and a dispensing port mounted behind said control plate at each end of said blade, the dispensing port having a second slot matching the first slot in said control plate, said control plate and dispensing port adapted to control flow of said mud.

9. The mud hopper of claim 8 wherein the dispensing port is plastic.

10. The mud hopper of claim 8 wherein said dispensing port contains a plurality of teeth.

11. The mud hopper of claim 8 wherein the control plate and blade are metal.

* * * * *